United States Patent [19]

Mitani et al.

[11] Patent Number: 5,052,944

[45] Date of Patent: Oct. 1, 1991

[54] LOW PROFILE COAXIAL CONNECTOR

[75] Inventors: Ikujiro Mitani; Fumio Kobayashi, both of Tokyo, Japan

[73] Assignee: Hirose Electric Co., Ltd., Tokyo, Japan

[21] Appl. No.: 646,200

[22] Filed: Jan. 28, 1991

[51] Int. Cl.[5] ..... H01R 4/24

[52] U.S. Cl. ..... 439/394; 439/581

[58] Field of Search ..... 439/394, 578–585

[56] References Cited

U.S. PATENT DOCUMENTS

| | | | |
|---|---|---|---|
| 4,583,813 | 4/1986 | Yamada | 339/91 R |
| 4,626,058 | 12/1986 | Prince et al. | 439/394 |
| 4,701,001 | 10/1987 | Verhoeren | 439/394 |
| 4,981,442 | 1/1991 | Shinizu et al. | 439/394 |

*Primary Examiner*—Joseph H. McGlynn

*Attorney, Agent, or Firm*—Kanesaka & Takeuchi

[57] ABSTRACT

A low profile connector for a coaxial cable, which includes a metal shell (1) with a cable gripper (3) extending from a side thereof for gripping the coaxial cable; a dielectric block (2) fitted into the metal shell and having a partition wall (4) for defining a contact recess (5) and a connection recess (6); and a U-shaped contact element (10) with a pair of leg members (11, 12) fitted into the contact and connection recesses, respectively, such that a leg member with a connection slit (12A) bites into a dielectric body of the coaxial cable and comes into contact with a central conductor by an insulation replacement technique while the other leg member is supported by the partition wall for contact with a contact element of a mating connector.

5 Claims, 4 Drawing Sheets

FIG. 2
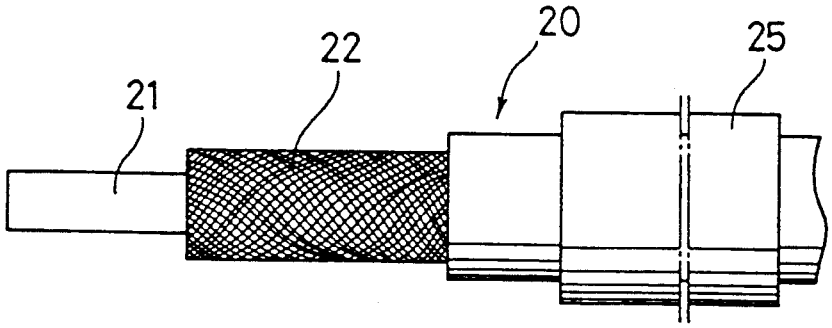
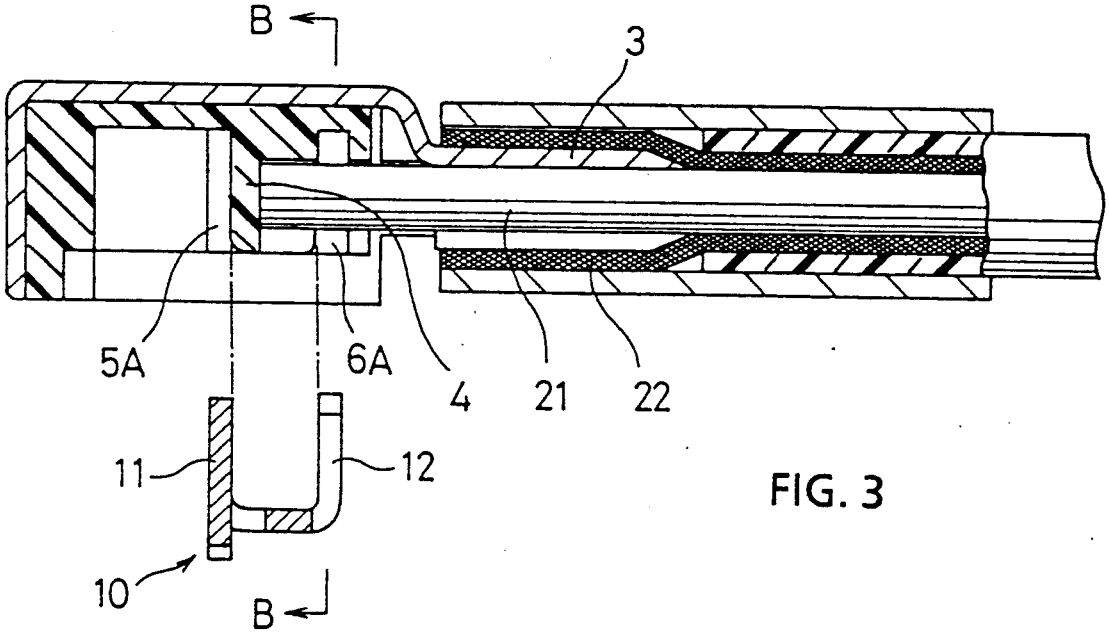
FIG. 3
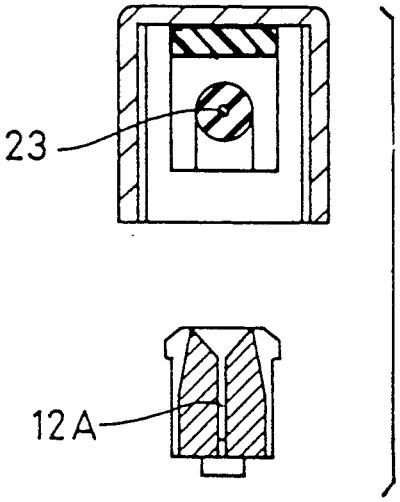
FIG. 4

LOW PROFILE COAXIAL CONNECTOR

BACKGROUND OF THE INVENTION

1. Field of the Invention

The present invention relates to a low profile coaxial plug connector.

2. Description of the Prior Art

Japanese UM Patent Application Kokai No. 61-99985 discloses an L-shaped connector such as shown in FIGS. 8 and 9. The connector includes an outer shell 110; a dielectric block 130 within the shell 110; and a tubular terminal 120 supported by the dielectric block 130 such that the front portion projects from the shell 110. The front portion of a central conductor 151 of a coaxial cable 150, from which a sheath 154, a shield 153, and an inner dielectric material 152 are removed, projects from the tubular terminal 120. A tubular retainer portion 117 integral with the shell 110 via a linkage portion is inserted between the dielectric material 152 and the shield wires 153. Then, as FIG. 9 shows, the tubular terminal 120 is either crimped or soldered to the central conductor 151, and the connector is bent between the shell 110 and retainer portion 117 by approximately 90 degrees and then the crimp sleeve 140 is deformed to secure the coaxial cable 150 to the retainer portion 117.

The assembled connector is coupled with a mating connector so that the central conductor comes into contact with the mating terminal for carrying a signal while the shell comes into contact with the corresponding shell for providing shielding effects.

However, the conventional connector has the following problems:

(1) A long front portion of the tubular terminal projects from the shell, and the connector is bent above the tubular terminal so that the connector profile becomes too high to be used in limited spaces.

(2) It is difficult to crimp or solder the tubular terminal to the central conductor.

(3) It is necessary to bend the linkage portion after the central conductor is inserted into the tubular terminal.

(4) It is necessary to fit the tubular terminal into the dielectric body.

SUMMARY OF THE INVENTION

Accordingly, it is an object of the invention to provide a compact L-shaped coaxial plug connector to which it is easy to connect a coaxial cable.

In accordance with the invention there is provided a low profile connector for a coaxial cable, which includes a metal shell with a cable gripper extending from a side thereof for gripping the coaxial cable; a dielectric block fitted into the metal shell and having a partition wall for defining a contact recess and a connection recess; and a U-shaped contact element with a pair of leg members fitted into the contact and connection recesses, respectively, such that a leg member with a connection slit bites into a dielectric body of the coaxial cable and comes into contact with a central conductor by an insulation replacement technique while the other leg member is supported by the partition wall for contact with a contact element of a mating connector.

The dielectric body of a coaxial cable, from which a sheath has been removed, is inserted into the connection recess of a low profile connector, and a contact element is fitted into the low profile connector. As a result, the contact element is held within the dielectric block, with a leg member biting into the dielectric body and comes into contact with the central conductor, thereby making an electrical connection by insulation replacement.

When a mating connector is plugged into the low profile connector, the contact element of the mating connector is fitted into the contact recess of the low profile connector so as to come into contact with a leg member of the low profile connector.

The above and other objects, features, and advantages of the invention will be more apparent from the following description when taken in conjunction with the accompanying drawings.

BRIEF DESCRIPTION OF THE DRAWINGS

FIG. 2 is a side view of a coaxial cable to be connected to the low profile connector;

FIG. 3 is a longitudinal section of the low profile connector into which the coaxial cable is inserted;

FIG. 4 is a cross section taken along the line B—B of FIG. 3;

DESCRIPTION OF THE PREFERRED EMBODIMENT

Figure 1:
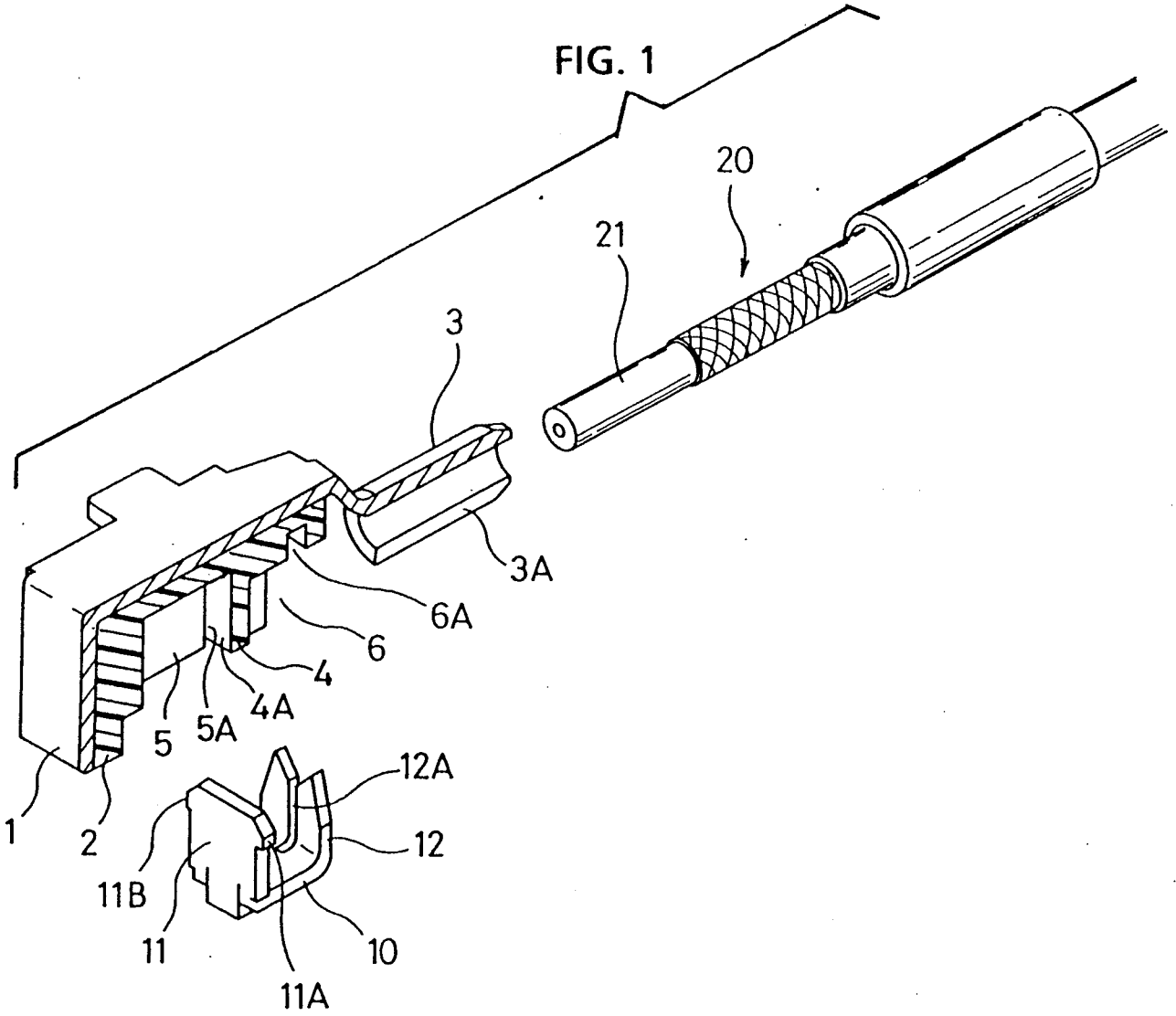
FIG. 1 is an exploded perspective view, sectional in part, of a low profile connector according to an embodiment of the invention.

FIG. 1 shows a low profile connector for a coaxial cable 20. The low profile connector includes a metal shell 1; a dielectric block 2 fitted into the metal shell 1; and a contact element 10 fitted into the dielectric block 2.

The metal shell 1 is made by stamping and forming a metal sheet. The metal shell 1 has a tubular cable gripper 3 with a slit 3A extending lengthwise for providing resilient property to the cable gripper 3.

The dielectric body 2 has a partition wall 4 for defining a contact recess 5 and a connection recess 6.

The contact element 10 is made by stamping and forming from a metal sheet so as to have a U-shaped cross section. A leg member 11 has a substantially flat surface for contact with the contact portion of a mating connector and at opposite upper corners a pair of barbs 11A and 11B for preventing the contact element 10 from falling off from the contact recess 5. Another leg member 12 has a connection slit 12A into which the central conductor of a coaxial cable 20 is connected by the insulation replacement technique. For this reason, the width of the connection slit 12A is set slightly less than the diameter of the central conductor of a coaxial cable. The leg member 12 has sharp front edges on opposite sides of the connection slit so that it is easy for the leg member 12 to bite into the dielectric body of a coaxial cable.

The leg members 11 and 12 of the contact element 10 are received in the contact recess 5 and connection recess 6 of the dielectric body 2, respectively.

The shape and size of the contact recess 5 are made such that the contact portion of a mating connector is fitted into the contact recess 5. The leg member 11 of the contact element 10 is guided and supported by a surface 4A of the partition wall 4, with the barbs 11A and 11B guided by engagement grooves 5A.

The connection recess 6 has a semi-circular guide surface on the ceiling along which the dielectric body 21 of a coaxial cable 20 is inserted until the front end of the coaxial cable 20 abuts on the partition wall 4. Also, it has an engagement groove 6A on the ceiling at right angles with the semi-circular guide surface at a position apart from the leg member 11 for a distance no more than that between the two leg members 11 and 12.

This low profile connector is used as follows:

(1) As FIG. 2 shows, a length of sheath is removed from a coaxial cable 20 so that a dielectric body 21 and a shield wires 22 are exposed. A crimp sleeve 25 is loosely fitted over the sheath.

(2) As FIGS. 3 and 4 show, the coaxial cable 20 is then inserted into the connector assembly until the front end of the dielectric body 21 abuts on the partition wall 4, with the tubular cable gripper 3 with a tapered front end inserted between the dielectric body 21 and the shield wires 22.

Figure 5:
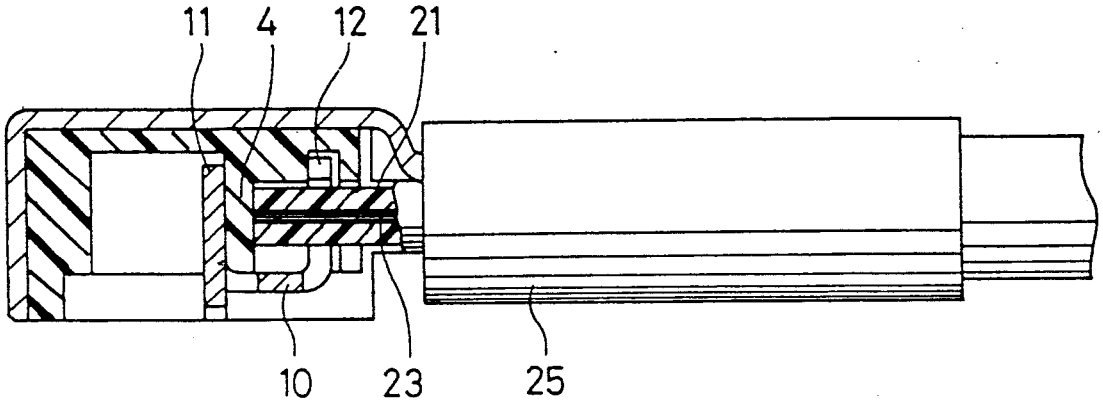
FIG. 5 is a longitudinal section of the low profile connector into which a contact element is fitted.

(3) Then, the contact element 10 is pushed into the connector so that the leg members 11 and 12 are fitted into the engagement grooves 5A and 6A, respectively. Consequently, as FIG. 5 shows, the leg member 12 bites into the dielectric body 21 coming into contact with the central conductor 23 in its connection slit 12A. The barbs 11A and 11B engage with the engagement grooves 5A to prevent the contact element 10 from falling off from the connector.

(4) Then, the crimp sleeve 25 is brought over the cable gripper 3 and deformed to secure the cable to the connector.

Figure 6:
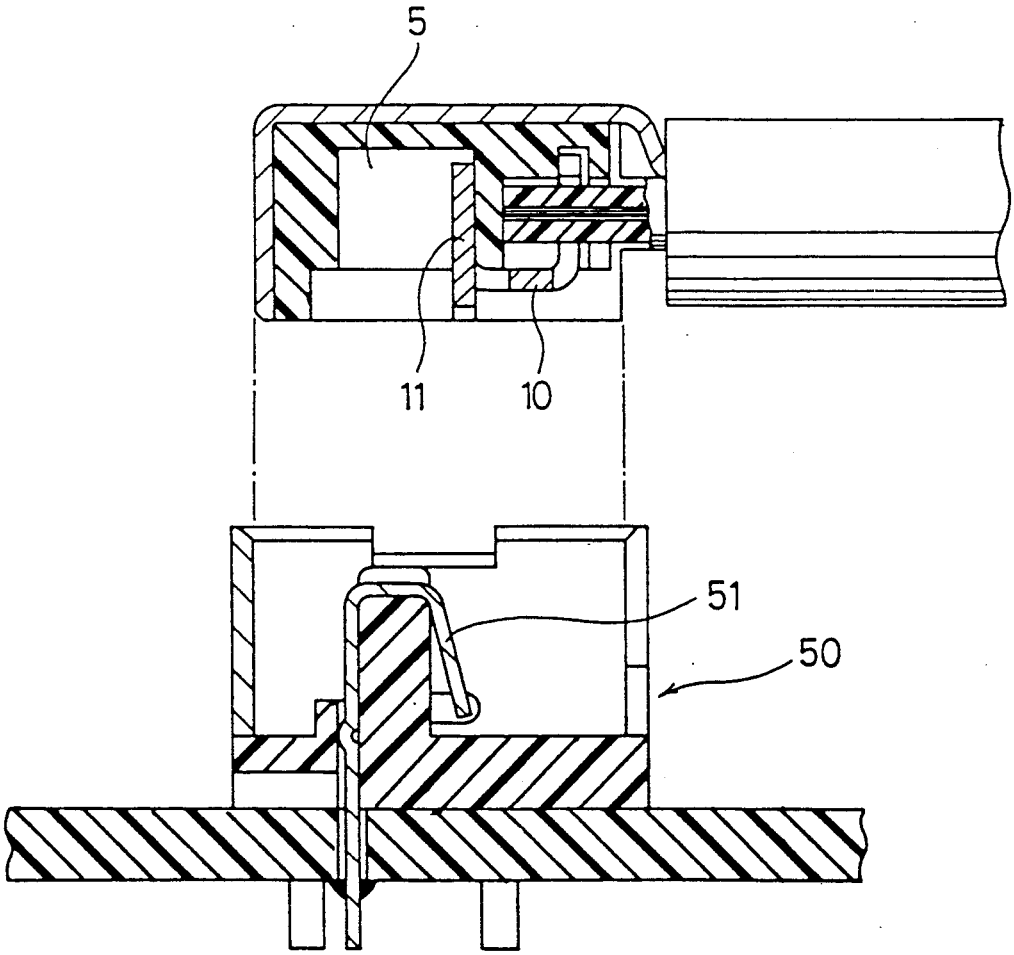
FIG. 6 is a longitudinal section of the low profile connector and a mating connector.
Figure 7:
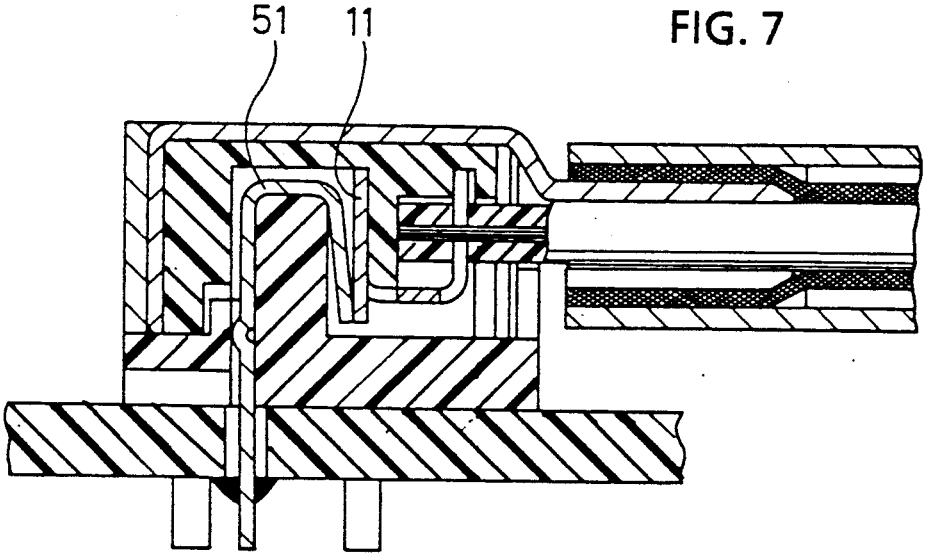
FIG. 7 is a longitudinal section of the low profile connector which receives the mating connector therein.
Figure 8:
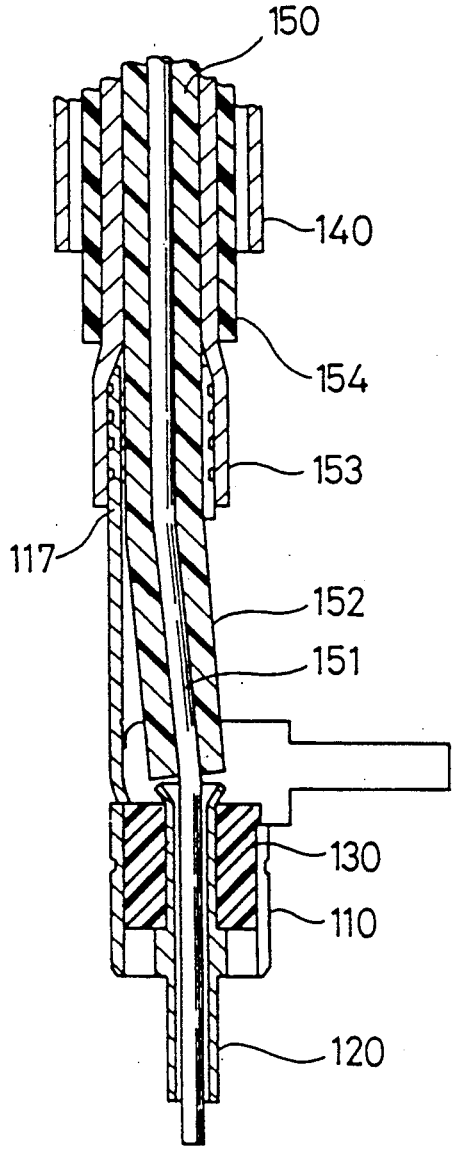
FIG. 8 PRIOR ART
FIG. 8 is a longitudinal section of a conventional connector before finish.
Figure 9:
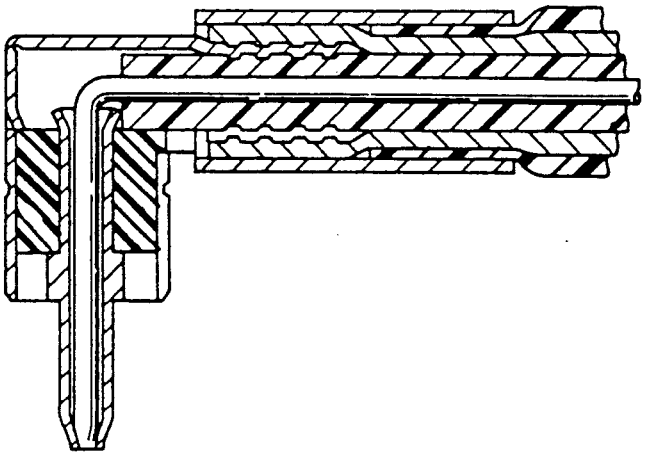
FIG. 9 PRIOR ART
FIG. 9 is a longitudinal section of a finished conventional connector.

(5) As FIGS. 6 and 7 show, the assembled connector is plugged into a mating connector 50 which has spring contact element 51. The spring contact element 51 of the mating connector 50 is received in the contact recess 5 of the connector so that it comes into contact with the leg member 11 of the contact element 10, thereby making an electrical connection.

The low profile connector according to the invention includes the following advantages:

(1) A coaxial cable extends laterally from a side of the connector, and the contact portion of a mating connector is received within the contact recess of the low profile connector. As a result, the profile of the connector is so low that it is possible to use the connector in a limited space.

(2) The central conductor is connected to the contact element by the insulation replacement technique, thereby making the assembling operation very easy.

(3) It is not necessary to insert the central conductor into the tubular terminal. In addition, the contact portion of a contact element is stronger than the tubular terminal, resulting in the increased reliability.

We claim:

1. A low profile connector for a coaxial cable, comprising:

a metal shell with a cable gripper extending laterally from a side thereof for gripping said coaxial cable;

a dielectric block fitted into said metal shell and having a partition wall for defining a contact recess and a connection recess; and a U-shaped contact element with a pair of leg members fitted into said contact and connection recesses, respectively, such that a leg member with a connection slit bites into a dielectric body of said coaxial cable and comes into contact with a central conductor by an insulation displacement technique while the other leg member is supported by said partition wall for contact with a contact element of a mating connector upon plugging.

2. The low profile connector of claim 1, wherein said connection slit extends in a mating direction wherein a mating connector is plugged into said low profile connector.

3. The low profile connector of claim 1, wherein said other leg member extends in the same direction as that of said leg member with said connection slit.

4. The low profile connector of claim 1, wherein said other leg member has a flat contact surface for contact with said contact element of said mating connector.

5. The low profile connector of claim 1, wherein said other leg member has a pair of engagement members on opposite upper corners for engagement with said dielectric block for securing said contact element to said dielectric block.

* * * * *